US005187737A

United States Patent [19]

Watanabe

[11] Patent Number: 5,187,737

[45] Date of Patent: Feb. 16, 1993

[54] POWER SUPPLY DEVICE FOR X-RAY TUBE

[75] Inventor: Kiyomi Watanabe, Tokyo, Japan

[73] Assignee: Origin Electric Company, Limited, Tokyo, Japan

[21] Appl. No.: 737,746

[22] Filed: Jul. 30, 1991

[30] Foreign Application Priority Data

Aug. 27, 1990 [JP] Japan ..... 2-224785
Jun. 4, 1991 [JP] Japan ..... 3-159593

[51] Int. Cl.[5] ..... H05G 1/20

[52] U.S. Cl. ..... 378/105; 378/104; 363/17

[58] Field of Search ..... 378/105, 101, 102, 103, 378/104, 106, 107, 109, 110; 363/17, 61, 62

[56] References Cited

U.S. PATENT DOCUMENTS

| | | | |
|---|---|---|---|
| 4,117,334 | 9/1978 | Strauts | 378/105 |
| 4,138,635 | 2/1979 | Quinn | 363/61 |
| 4,317,039 | 2/1982 | Romandi | 378/105 |
| 4,400,822 | 8/1983 | Kühnke et al. . | |
| 4,456,489 | 10/1985 | Kühnke et al. . | |
| 4,504,895 | 3/1985 | Stelgerwald . | |
| 4,514,795 | 4/1985 | van der Zwart . | |
| 4,597,026 | 6/1986 | Santurtun et al. . | |
| 4,601,051 | 7/1986 | Santurtun et al. . | |
| 4,641,330 | 2/1987 | Herwig et al. . | |
| 4,661,896 | 4/1987 | Kobayashi et al. . | |
| 4,691,272 | 9/1987 | Geus . | |
| 4,720,844 | 1/1988 | Bougle . | |
| 4,737,974 | 4/1988 | Hino et al. | 378/105 |

FOREIGN PATENT DOCUMENTS

| | | | |
|---|---|---|---|
| 0290700 | 12/1986 | Japan | 378/104 |

*Primary Examiner*—David P. Porta
*Attorney, Agent, or Firm*—Lowe, Price, LeBlanc & Becker

[57] ABSTRACT

A power supply device for an X-ray tube includes first and second capacitors connected in series at one ends thereof which are connected with a secondary winding of a high-tension transformer. Connectedly arranged between a positive output terminal and the ground are first and second diodes which are connected in series to assume the same polarity, each having a cathode as a positive output side, a connecting point of the first and second diodes being connected with the other end of the first capacitor. Also connectedly arranged between a negative output terminal and the ground are third and fourth diodes which are connected in series to assume the same polarity, each having an anode as a negative output side, a connecting point of said third and fourth diodes being connected with the other end of the second capacitor. First and second high-tension cables include a covering conductor connected with the ground, respectively. The first high-tension cable is connectedly arranged between the positive output terminal and an anode of the X-ray tube, whereas the second high-tension cable is connectedly arranged between the negative output terminal and a cathode of the X-ray tube.

12 Claims, 3 Drawing Sheets

POWER SUPPLY DEVICE FOR X-RAY TUBE

BACKGROUND OF THE INVENTION

The present invention relates to a power supply device for an X-ray tube using a high-frequency inverter.

Various kinds of power supply devices for an X-ray tube using a high-frequency inverter of some kHz to tens kHz have been proposed, in recent years, in view of high-speed response characteristic and low ripple characteristic. Such power supply devices for an X-ray tube are disclosed. For example, in U.S. Pat. No. 4,720,844 issued Jan. 19, 1988 to J. Bougle, U.S. Pat. No. 4,400,822 issued Aug. 23, 1983 to Kuhnke et al., and U.S. Pat. No. 4,117,334 issued Sep. 26, 1978 to E. J. Strauts.

FIG. 3 shows a known power supply device for an X-ray tube of the type. This power supply device includes a direct current (DC) power supply 1 having an accumulator or a rectifier, a high-frequency inverter 2 for converting DC voltage of the DC power supply into high-frequency voltage, a high-tension transformer 3, and a high-tension bridge rectifier 4. Usually, the high-tension transformer 3 and the high-tension bridge rectifier 4 are received in a metallic high-tension tank 5 filled with insulation oil, and grounded.

The power supply device for an X-ray tube has positive and negative output terminals which are connected with an anode A and a cathode K of an X-ray tube 8 through two high-tension cables 6 and 7. The high-tension cables 6 and 7 include covering conductors 6*a* and 7*a*, respectively, which are grounded through a casing of the high-tension tank 5. A tube current detecting circuit 9 is arranged to determine a tube current of the X-ray tube 8 out of a current passing a midpoint between two secondary windings N2 and N'2 of the high-tension transformer 3. A filament power supply is further needed to operate the X-ray tube 8, however, a description thereof is omitted due to an absence of direct connection with the present invention.

The operation of the power supply device for an X-ray tube will be described. A high-frequency output voltage of the high-frequency inverter 2 is supplied to the high-tension transformer 3 at a primary winding N1 thereof. The two secondary windings N2 and N'2 of the high-tension transformer 3, which are the same in number of turns, are connected in series to assume the same polarity, and have a connecting point a which is a neutral point of an output of this power supply device, and grounded. The tube current detecting circuit 9 is insertedly arranged to the secondary winding N'2.

Assuming a voltage generated in each of the secondary windings N2 and N'2 to be E, the high-tension bridge rectifier 4 receives an alternating current (AC) input voltage of 2 E, and provides a rectified voltage of 2 E. Since the connecting point a of the secondary windings N2 and N'2 is grounded, the power supply device has a positive output voltage of +E, and a negative output voltage of −E. These voltages are applied to the X-ray tube 8 at the anode A and the cathode K thereof through the positive and negative high-tension cables 6 and 7.

For facilitating a high-tension insulation construction of the power supply device, the connecting point a of the secondary windings N2 and N'2 is grounded, and the anode voltage is set to +E while the cathode voltage is set to −E. With such power supply device for an X-ray tube of the high-frequency type, capacitances between core wires of the high-tension cables 6, 7 and the covering conductors 6*a*, 7*a* assume a filter effect, resulting in a decreased high-frequency ripple of a voltage to be applied between the anode A and the cathode K of the X-ray tube 8.

A problem faced in such known power supply device for an X-ray tube is that:

1—each of the capacitances of the high-tension cables 6 and 7 merely serves as a ripple reduction filter; and 2—since the tube current is detected at the series connecting point a of the secondary windings N2 and N'2 of the high-tension transformer 3, a charge/discharge current of a distributed earth capacitance of each of the secondary windings N2 and N'2 is detected simultaneously, resulting in a difficulty of accurately detecting the tube current as a frequency of the high-frequency inverter 2 increases.

It is, therefore, an object of the present invention to provide a power supply device for an X-ray tube having a decreased size, and a reduced manufacturing cost.

It is another aspect of the present invention to provide a power supply device for an X-ray tube which allows an accurate detection of a tube current of an X-ray tube.

SUMMARY OF THE INVENTION

According to one aspect of the present invention, there is provided an X-ray device having an X-ray tube, positive and negative output terminals, and a neutral point between positive and negative output voltages which is connected with the ground, the X-ray device comprising:

a high-tension inverter;

a high-tension transformer having primary and secondary windings, said primary winding being connected with said high-tension inverter, said secondary winding having one end connected with the ground;

first and second capacitors connected in series at one ends thereof, said one ends of said first and second capacitors being connected with said secondary winding of said high-tension transformer at the other end thereof;

third and fourth capacitors connected in series at one ends thereof, said one ends of said third and fourth capacitors being connected with the ground, said third capacitor having the other end connected with the positive output terminal, said fourth capacitor having the other end connected with the negative output terminal;

first and second diodes connected in series, said first diode having an anode connected with said second diode at a cathode thereof, said anode of said first diode and said cathode of said second diode being connected with the other end of said first capacitor, said first diode having a cathode connected with the positive output terminal, said second diode having an anode connected with the ground; and third and fourth diodes connected in series, said third diode having a cathode connected with said fourth diode at an anode thereof, said cathode of said third diode and said anode of said fourth diode being connected with the other end of said second capacitor, said third diode having an anode connected with the negative output terminal, said fourth diode having a cathode connected with the ground.

According to another aspect of the present invention, there is provided an X-ray device having an X-ray tube, positive and negative output terminals, and a neutral point between positive and negative output voltages which is connected with the ground, the X-ray device comprising:

a high-tension inverter;

a high-tension transformer having primary and secondary windings, said primary winding being connected with said high-tension invertor, said secondary winding having one end connected with the ground;

first and second capacitors connected in series at one ends thereof, said one ends of said first and second capacitors being connected with said secondary winding of said high-tension transformer at the other end thereof;

first and second diodes connected in series, said first diode having an anode connected with said second diode at a cathode thereof, said anode of said first diode and said cathode of said second diode being connected with the other end of said first capacitor, said first diode having a cathode connected with the positive output terminal, said second diode having an anode connected with the ground;

third and fourth diodes connected in series, said third diode having a cathode connected with said fourth diode at an anode thereof, said cathode of said third diode and said anode of said fourth diode being connected with the other end of said second capacitor, said third diode having an anode connected with the negative output terminal, said fourth diode having a cathode connected with the ground; and first and second high-tension cables having a covering conductor connected with the ground, respectively, said first high-tension cable connectedly arranged between the positive output terminal and an anode of the X-ray tube, said second high-tension cable connectedly arranged between the negative output terminal and a cathode of the X-ray tube.

DETAILED DESCRIPTION OF THE INVENTION

Figure 1:
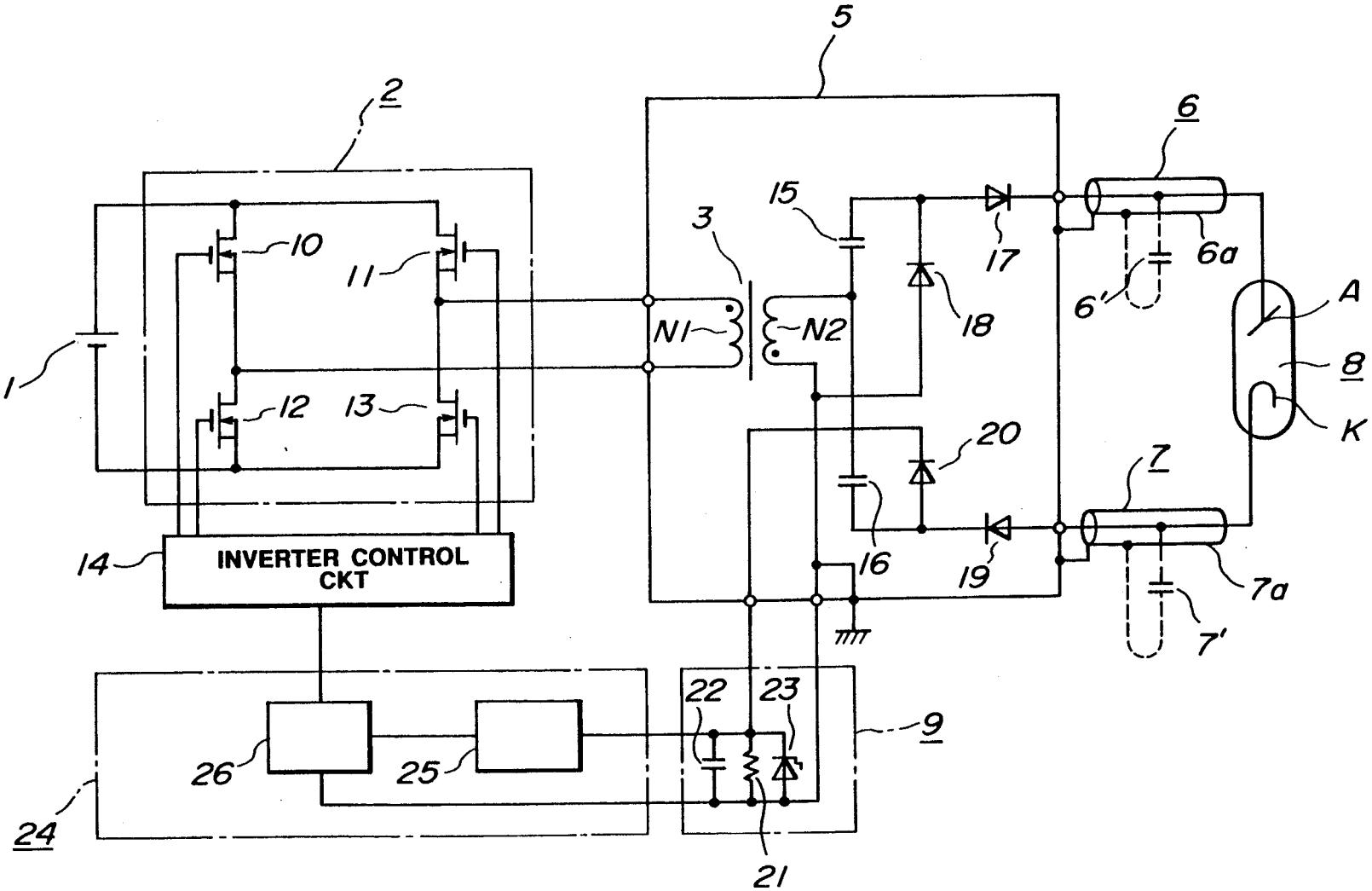
FIG. 1 is a circuit diagram illustrating a first preferred embodiment of a power supply device for an X-ray tube according to the present invention.

Referring to FIG. 1, there is shown a first preferred embodiment of a power supply device for an X-ray tube according to the present invention.

Figure 3:
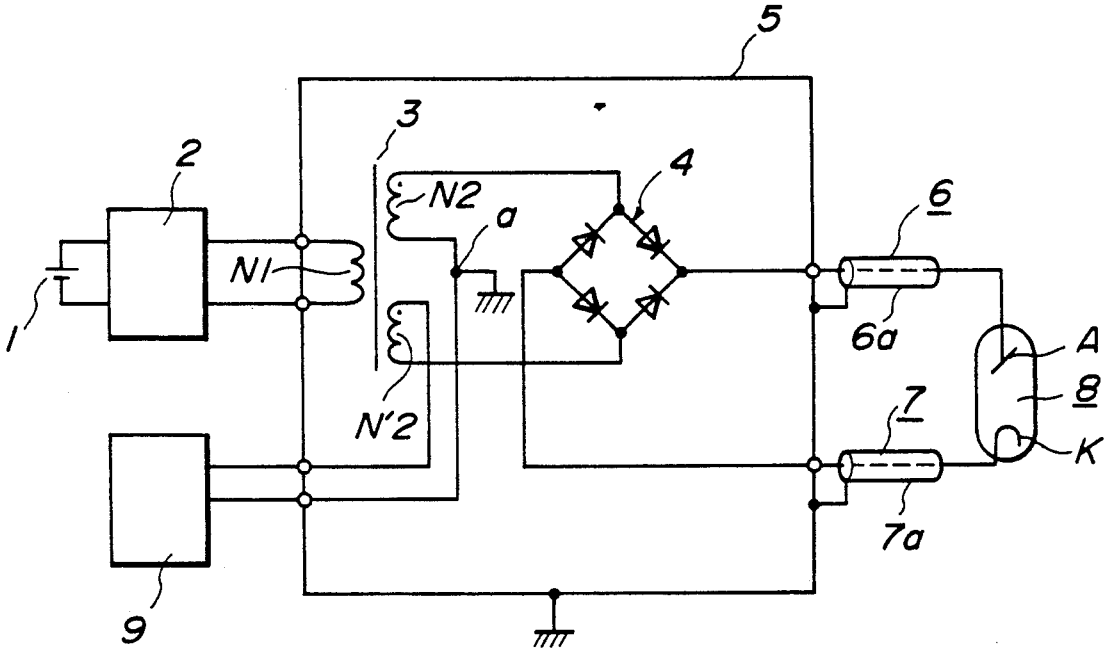
FIG. 3 (PRIOR ART)
FIG. 3 is a view similar to FIG. 2, illustrating a known power supply device for an X-ray tube.

Referring to FIG. 1, wherein like reference numerals in FIG. 3 designate corresponding parts, a power supply device for an X-ray tube includes a high-frequency inverter 2 which in turn includes a bridge having field effect transistors (FETs) 10 to 13. The FETs 10 to 13 are controlled according to any control method such as a pulse width modulation, a frequency modulation, etc. by an inverter control circuit 14 isolated by a pulse transformer and the like. An output of the high-frequency inverter 2 is supplied to the high-tension transformer 3 at a primary winding N1 thereof. The high-tension transformer 3 includes a single secondary winding N2 having a start terminal grounded, and a high-tension end terminal connected to a connecting point of a first capacitor 15 and a second capacitor 16 which are connected in series.

Connectedly arranged between a positive output terminal of the power supply device for an X-ray tube and the ground are a first diode 17 and a second diode 18 which are connected in series to assume the same polarity, each having a cathode as a positive output side. The first capacitor 15 has the other end connected to a connecting point of the first and second diodes 17 and 18. Additionally, connectedly arranged between a negative output terminal of the power supply device for an X-ray tube and the ground are a third diode 19 and a fourth diode 20 which are connected in series to assume the same polarity, each having an anode as a negative output side. The second capacitor 16 has the other end connected to a connecting point of the third and fourth diodes 19 and 20.

The high-tension transformer 3, the capacitors 15, 16, and the diodes 17 to 20 are received in a metallic high-tension tank 5 filled with insulation oil, and grounded. Outside the high-tension tank 5, a tube current detecting circuit 9 is connectedly arranged between the cathode of the forth diode 20 and the ground. The positive output terminal of the power supply device and an anode A of an X-ray tube 8 are connected by a first high-tension cable 6, while the negative output terminal of the power supply device and a cathode K of the X-ray tube 8 are connected by a second high-tension cable 7. The first and second high-tension cables 6 and 7 are substantially the same in length, and enveloped by covering conductors 6*a* and 7*a* through insulators, respectively, which are grounded through a casing of the high-tension tank 5. The first and second high-tension cables 6 and 7 have earth capacitances 6' and 7', respectively, which correspond to third and fourth capacitors.

The tube current detecting circuit 9 is arranged to detect a tube current of the X-ray tube 8, i.e., an average value of a cathode current of the fourth diode 20 which is equal to the tube current, and includes a resistor 21 for converting a detected current into a voltage, a capacitor 22 for absorbing a pulse constituent in the detected current, and a voltage regulator diode 23 for protecting the tube current detecting circuit 9 from an excessive current which may be produced upon short-circuit of the X-ray tube 8 and the like. An output of the tube current detecting circuit 9 is provided to a current/time multiplication (hereinafter referred to as mAS) control circuit 24 which includes an integrator 25, and a comparator 26.

Next, the operation of this embodiment will be described.

When the FETs 10 to 13 are supplied with a direct current (DC) voltage out of a DC power supply 1, and controlled by the invertor control circuit 14 isolated by a pulse transformer and the like according to any control method such as a pulse width modulation, a frequency modulation, etc., the high-frequency invertor 2 produces a high-frequency output voltage which is applied to the high-tension transformer 3 at the primary winding N1 thereof.

Let's suppose that the earth capacities 6' and 7' of the first and second high-tension cables 6 and 7 for general use of an X-ray tube are, for example, 100 pF per meter. When the first and second high-tension cables 6 and 7 are 4 meters in length, a value of each of the earth capacities 6' and 7' is 400 pF.

It is to be noted that a circuit from the secondary winding N2 of the high-tension transformer 3 to the earth capacities 6' and 7' of the first and second high-tension cables 6 and 7 includes two single-stage half-wave voltage doubler rectifier circuits for use in a power supply circuit of the ordinary type, which are connected symmetrically to assume the reversed polarity. Accordingly, the two half-wave voltage doubler rectifier circuits rectify a voltage E produced in the secondary winding N2 of the high-tension transformer 3 to obtain rectified voltages of +2E and −2E, thus supplying the X-ray tube 8 with a voltage of 4E. It will be understood that a value of the voltage E may be ½ the conventional one.

Since a midpoint between the earth capacitances 6' and 7' of the first and second high-tension cables 6 and 7 is grounded, the X-ray tube 8 assumes at each terminal thereof an earth potential which is ½ a tube voltage across the X-ray tube 8, resulting in advantage in insulation construction of the power supply device for an X-ray tube. Specifically, if the power supply device is constructed by grounding the X-ray tube 8 of 125 kV in rated voltage at a positive or negative side thereof, the insulation construction should be 125 kV, while in case of such midpoint ground, it may be 62.5 kV. Since a reduction in voltage facilitates the insulation construction with increasing speed, such 50% reduction in voltage is advantageous in the extreme.

Further, since a frequency of a ripple voltage of each of the earth capacitances 6' and 7' of the first and second high-tension cables 6 and 7 is identical to an operating frequency of the high-frequency inverter 2, and the two frequencies are opposite in phase, high-frequency ripples to the ground to be applied to the anode A and the cathode K of the X-ray tube 8 are negated each other. As a result, the ripple voltage as produced between the anode A and the cathode K of the X-ray tube 8 may be substantially identical to or smaller than same of a known bridge rectification.

A detected voltage of the tube current detecting circuit 9 is integrated by the integrator 25 in the mAS control circuit 24 so as to obtain a mAS signal. The mAS signal is compared with a mAS setting by the comparator 26. With the high-frequency inverter 2 turned on, the tube current begins passing to increase the mAS signal. When the mAS signal reaches the setting, the comparator 26 provides an inverter OFF signal to the inverter control circuit 14 so as to interrupt the supply of the tube voltage. In such a manner, an X-ray exposure time is automatically determined.

It is to be noted that the mAS control circuit 24 may be omitted. In that event, the tube current of the X-ray tube 8 as detected by the tube current detecting circuit 9 is compared with a setting thereof to obtain a difference between the two. A filament current of the X-ray tube 8 is controlled by an error signal indicative of the difference so as to control the tube current in a constant-current manner.

Figure 2:
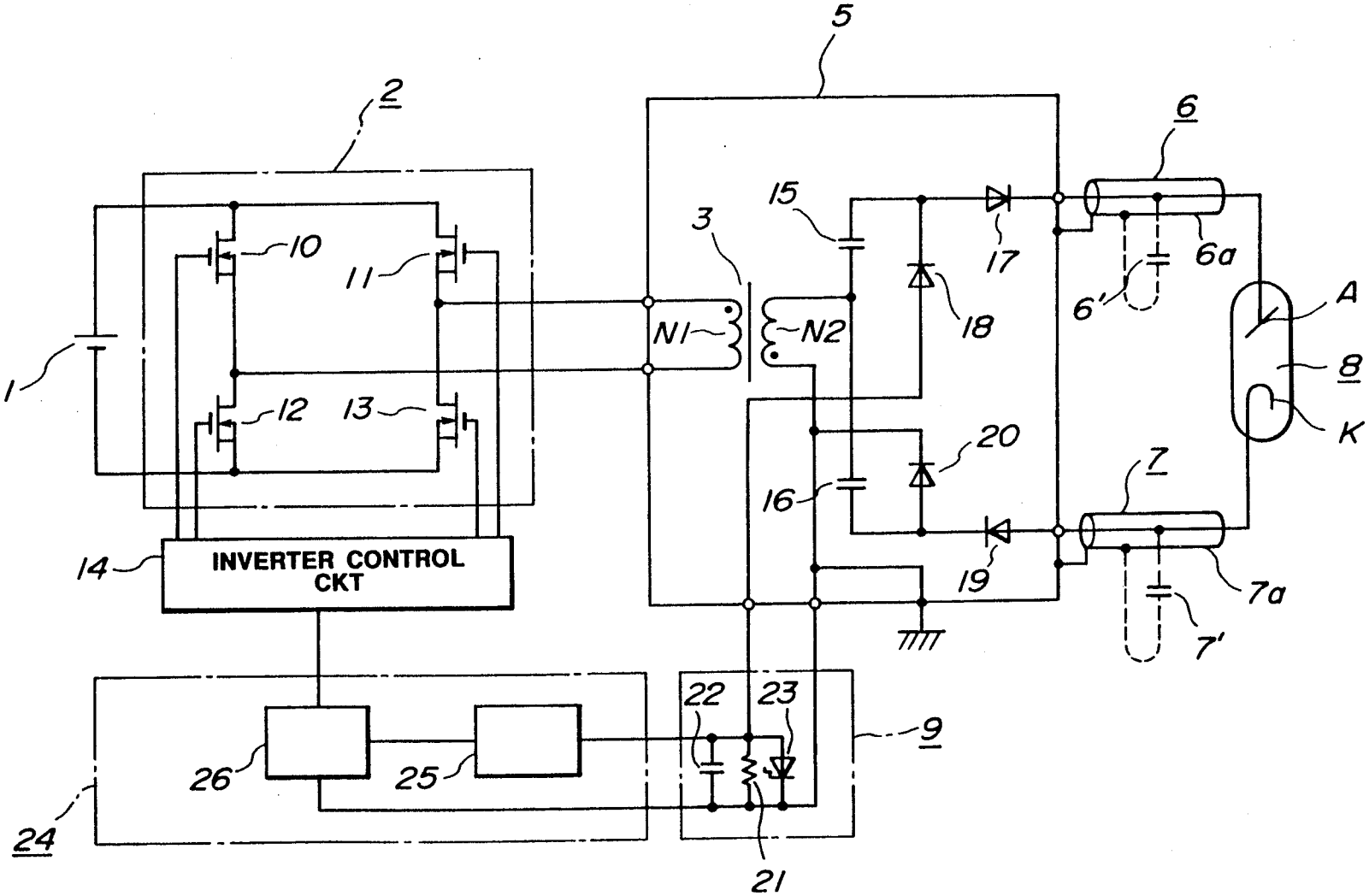
FIG. 2 is a view similar to FIG. 1, illustrating a second preferred embodiment of the present invention.

Referring to FIG. 2, there is shown a second preferred embodiment of the present invention.

The architecture of the second preferred embodiment is substantially the same as that one of the first preferred embodiment as shown in FIG. 1. In the first preferred embodiment, the tube current detecting circuit 9 is connectedly arranged between the cathode of the fourth diode 20 and the ground so as to detect a cathode current of the fourth diode 20. On the other hand, in the second preferred embodiment, the tube current detecting circuit 9 is connectedly arranged between the anode of the second diode 18 and the ground so as to detect an anode current of the second diode 18. In that event, the detected voltage is negative with respect to the ground. In the second preferred embodiment the same as in the first preferred embodiment, since an average value of the anode current of the second diode 18 is equal to the tube current of the X-ray tube 8, the tube current of the X-ray tube 8 can be detected by the tube current detecting circuit 9.

In the aforementioned embodiments, since each of the earth capacitances 6' and 7' of the high-tension cables 6 and 7 serves not only a ripple reduction filter, but a voltage multiplier, a high-tension generator portion of the power supply device for an X-ray tube can be simplified in architecture, resulting in a reduction in size of the power supply device, and also in a reduction in a manufacturing cost thereof.

It is to be noted that the voltage doubler rectifier circuits in the aforementioned embodiments compose a single-stage Cockcroft-Walton (CW) circuit. If a power supply device for an X-ray tube includes a multistage CW circuit, the number of step-up capacitors increases in proportion to the number n of stages, and a ripple in the CW circuit increases in proportion to a square of the number n. Accordingly, a number of capacitors having a large capacity should be arranged to obtain a great tube current (tens mA to hundreds mA) of an X-ray tube, resulting in impossibility of a reduction in size of the power supply device. In view of this reduction in size, the use of the multistage CW circuit is not favorable in the aforementioned embodiments. Thus, it will be understood that the power supply device according to the present invention is particularly useful for an X-ray device of some kW to tens kW having a great tube current.

Further, in the aforementioned embodiments, since the tube current of the X-ray tube 8 can be determined by detecting the DC current passing through the diode 20 or 18 as grounded, a charge/discharge current of the earth capacitance of the secondary winding N2 of the high-tension transformer 3 fails to pass through the tube current detecting circuit 9, resulting in an accurate detection of the tube current with the tube current detecting circuit 9 as simply constructed.

Experiment has shown that a practicable characteristic of an output of 100 kV in tube voltage and 100 mA in tube current can be obtained by the high-frequency inverter 2 of 20 kHz, the high-tension transformer 3 of about 25 kV in secondary winding voltage, the two step-up capacitors 15 and 16 of 1,000 pF, 30 kV, the four high-tension diodes 17 to 20 of 60 kV in withstand voltage, and the positive and negative high-tension cables 6 and 7 of 4 meters in length (=400 pF, respectively).

In the aforementioned embodiments, if a further reduction in ripple of the tube voltage is needed, two capacitors, each having relatively small capacity with respect to the earth capacitance of each of the high-tension cables 6 and 7, may be connectedly arranged between the positive and negative output terminals and the ground, respectively.

What is claimed is:

1. An X-ray device having an X-ray tube, positive and negative output terminals, and a neutral point between positive and negative output voltages which is connected with a ground, the X-ray device comprising:

a high-tension inverter;

a high-tension transformer having primary and secondary windings, said primary winding being connected with said high-tension inverter, said secondary winding having one end connected with the ground and having another end;

first and second capacitors connected in series at first ends thereof, said first ends of said first and second capacitors being connected with said another end of said secondary winding of said high-tension transformer;

third and fourth capacitors connected in series at first ends thereof, said first ends of said third and fourth capacitors being connected with the ground, said third capacitor having a second end thereof connected with the positive output terminal, said fourth capacitor having a second end thereof connected with the negative output terminal, said third capacitor including an earth capacitance of a first high-tension cable connectedly arranged between said positive output terminal and an anode of the X-ray tube, said fourth capacitor including an earth capacitance of a second high-tension cable connectedly arranged between said negative output terminal and a cathode of the X-ray tube;

first and second diodes connected in series, said first diode having an anode connected with said second diode at a cathode thereof, said anode of said first diode and said cathode of said second diode being connected with a second end of said first capacitor, said first diode having a cathode connected with the positive output terminal, said second diode having an anode connected with the ground; and third and fourth diodes connected in series, said third diode having a cathode connected with said fourth diode at an anode thereof, said cathode of said third diode and said anode of said fourth diode being connected with a second end of said second capacitor, said third diode having an anode connected with the negative output terminal, said fourth diode having a cathode connected with the ground.

2. An X-ray device as claimed in claim 1, wherein said secondary winding of said high-tension transformer is single in number.

3. An X-ray device as claimed in claim 1, wherein said first and second high-tension cables are substantially the same in length.

4. An X-ray device as claimed in claim 1, further comprising:

tube current detecting circuit means for detecting a current passing through the X-ray tube.

5. An X-ray device as claimed in claim 4, wherein said tube current detecting circuit means are connectedly arranged between said cathode of said fourth diode and the ground.

6. An X-ray device as claimed in claim 4, wherein said tube current detecting circuit means are connectedly arranged between said anode of said second diode and the ground.

7. An X-ray device having an X-ray tube, positive and negative output terminals, and a neutral point between positive and negative output voltages which is connected with the ground, the X-ray device comprising:

a high-tension inverter;

a high-tension transformer having primary and secondary windings, said primary winding being connected with said high-tension invertor, said secondary winding having one end connected with the ground;

first and second capacitors connected in series at one ends thereof, said one ends of said first and second capacitors being connected with said secondary winding of said high-tension transformer at the other end thereof;

first and second diodes connected in series, said first diode having an anode connected with said second diode at a cathode thereof, said anode of said first diode and said cathode of said second diode being connected with the other end of said first capacitor, said first diode having a cathode connected with the positive output terminal, said second diode having an anode connected with the ground;

third and fourth diodes connected in series, said third diode having a cathode connected with said fourth diode at an anode thereof, said cathode of said third diode and said anode of said fourth diode being connected with the other end of said second capacitor, said third diode having an anode connected with the negative output terminal, said fourth diode having a cathode connected with the ground; and first and second high-tension cables having a covering conductor connected with the ground, respectively, said first high-tension cable connectedly arranged between the positive output terminal and an anode of the X-ray tube, said second high-tension cable connectedly arranged between the negative output terminal and a cathode of the X-ray tube.

8. An X-ray device as claimed in claim 7, wherein said secondary winding of said high-tension transformer is single in number.

9. An X-ray device as claimed in claim 7, wherein said first and second high-tension cables are substantially the same in length.

10. An X-ray device as claimed in claim 7, further comprising:

tube current detecting circuit means for detecting a current passing through the X-ray tube.

11. An X-ray device as claimed in claim 10, wherein said tube current detecting circuit means are connectedly arranged between said cathode of said fourth diode and the ground.

12. An X-ray device as claimed in claim 10, wherein said tube current detecting circuit means are connectedly arranged between said anode of said second diode and the ground.

* * * * *

UNITED STATES PATENT AND TRADEMARK OFFICE

CERTIFICATE OF CORRECTION

PATENT NO. : 5,187,737

DATED : February 16, 1993

INVENTOR(S) : Kiyomi WATANABE

It is certified that error appears in the above-identified patent and that said Letters Patent is hereby corrected as shown below:

Column 2, line 33, change "high-tension" to --high-frequency--;

line 36, change "high-tension" to --high-frequency--.

Column 3, line 4, change "high-tension" to --high-frequency--;

line 7, change "high-tension" to --high-frequency--.

Column 6, line 63, change "high-tension" to --high-frequency--;

line 66, change "high-tension" to --high-frequency--.

Column 8, line 3, change "high-tension" to --high-frequency--.

UNITED STATES PATENT AND TRADEMARK OFFICE

CERTIFICATE OF CORRECTION

PATENT NO. : 5,187,737

DATED : February 16, 1993

INVENTOR(S) : Kiyomi Watanabe

It is certified that error appears in the above-indentified patent and that said Letters Patent is hereby corrected as shown below:

Column 8, line 6, change "hig-tension" to --high-frequency--.

Signed and Sealed this

Twenty-second Day of February, 1994

*Attest:*

Bruce Lehman

BRUCE LEHMAN

*Attesting Officer*

*Commissioner of Patents and Trademarks*